United States Patent [19]

Barthlome

[11] Patent Number: 4,671,258

[45] Date of Patent: Jun. 9, 1987

[54] THERAPEUTIC MULTIPLE JOINT EXERCISER

[76] Inventor: Donald E. Barthlome, 313 Orange Plank Rd., Hampton, Va. 23669

[21] Appl. No.: 697,385

[22] Filed: Feb. 1, 1985

Related U.S. Application Data

[63] Continuation-in-part of Ser. No. 570,091, Jan. 12, 1984.

[51] Int. Cl.[4] ..... A61H 1/02

[52] U.S. Cl. ..... 128/26; 128/25 R; 128/DIG. 20

[58] Field of Search ..... 128/25 R, 26, DIG. 20; 272/67, 68

[56] References Cited

U.S. PATENT DOCUMENTS

| | | | |
|---|---|---|---|
| D. 188,423 | 7/1960 | Fox | 272/68 X |
| 3,020,908 | 2/1962 | Daniels et al. . | |
| 3,245,405 | 4/1966 | Gardner | 128/DIG. 20 X |
| 3,457,912 | 7/1969 | Clark et al. . | |
| 3,581,740 | 6/1971 | Sherbourne . | |
| 3,756,222 | 9/1973 | Ketchum . | |
| 3,937,215 | 2/1976 | Barthlome . | |

*Primary Examiner*—Robert A. Hafer
*Assistant Examiner*—Kathleen J. D'Arrigo
*Attorney, Agent, or Firm*—Sandler & Greenblum

[57] ABSTRACT

A cyclical therapeutic joint exerciser is provided; it alternatively imparts a straightening and bending motion to a desired joint of a patient, e.g., a finger, elbow or knee. The device primarily consists of an inflatable pouch to which a spring steel member is removably attached. The spring or springs maintain the body portion in a flexed, non-extended position when the pouch remains uninflated. As the pouch is inflated, the springs mounted on the pouch, which are normally in a bent position, are extended along with the joint. When the pouch is deflated, the inherent biasing action of the springs causes the pouch and springs to bend, which brings the joint back to the flexed position.

21 Claims, 17 Drawing Figures

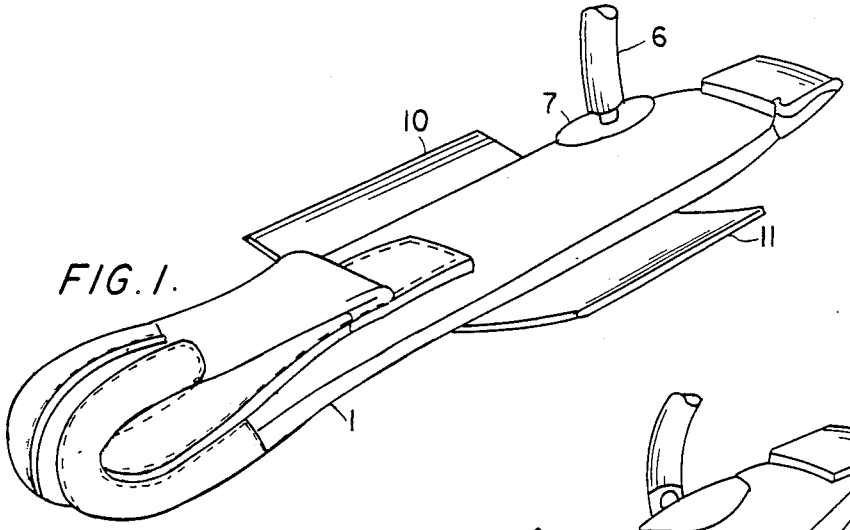
FIG. 1.
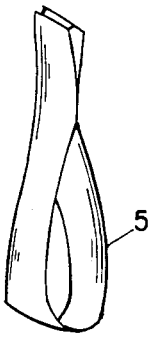
FIG. 5.
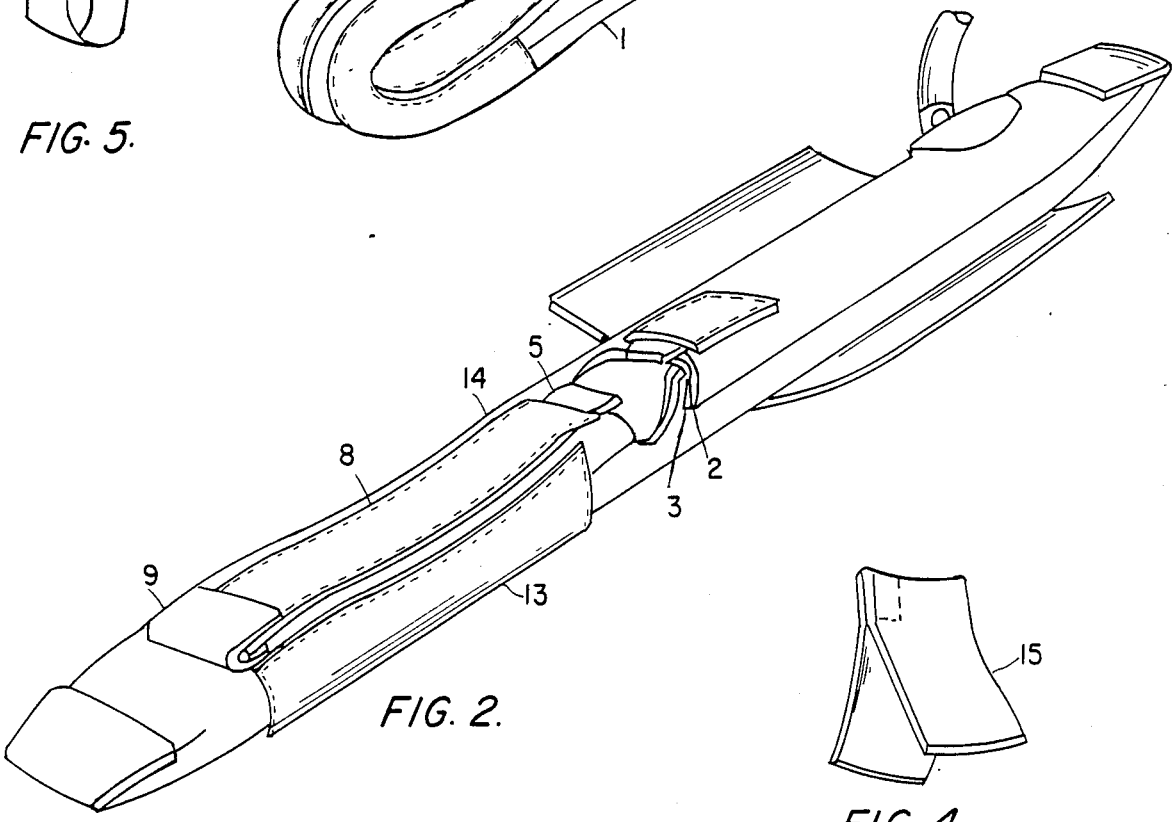
FIG. 2.
FIG. 4.
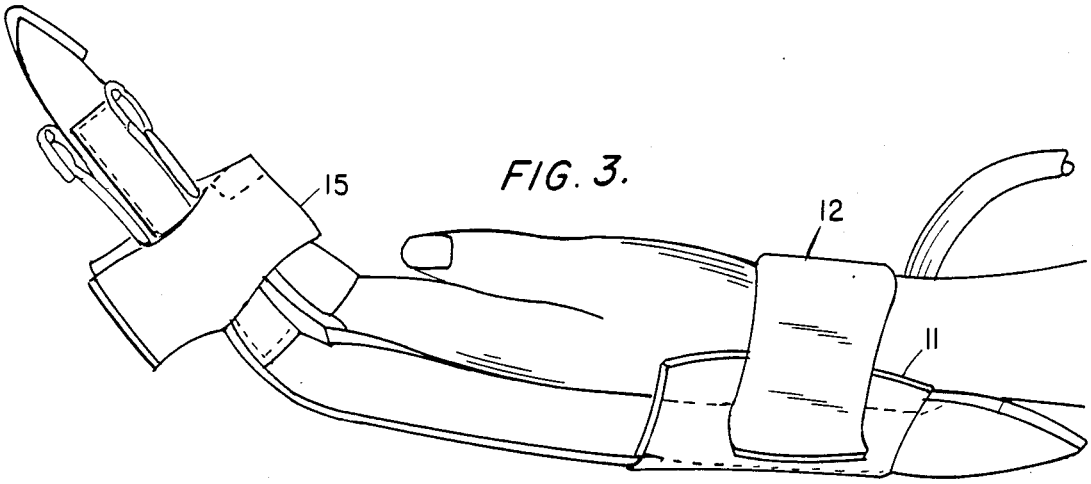
FIG. 3.

THERAPEUTIC MULTIPLE JOINT EXERCISER

This is a continuation-in-part of U.S. patent application Ser. No. 570,091, filed on Jan. 12, 1984 in the U.S. Patent and Trademark Office, the disclosure of which is hereby expressly incorporated by reference in its entirety.

BACKGROUND OF THE INVENTION

1. Field of the Invention

The present invention generally relates to exercising devices for body portions which cannot otherwise be easily and efficiently exercised, and more specifically to a new and improved inflatable body part exerciser which is capable of exercising a patient's hand, arm, leg or other joint by moving it between a first, non-extended position, and a second, extended position.

2. Discussion of Prior Art

The present invention relates to therapeutic exercise devices for incapacitated body portions and is capable of moving the body portions in a simple and effective manner in order to exercise them at desired times and rates.

Applicant's own prior patent, U.S. Pat. No. 3,937,215, discloses a cyclic therapeutic hand exerciser which is adapted to move the fingers of a user in accordance with inflation and deflation of selected bag-like or pouch-like portions. This apparatus was designed to pull the fingertips of a patient and to curl them inwardly towards the palm of the patient upon inflation and deflation of the pouches. Air pressure inflates a splintlike upper member to straighten the fingers, and when this splintlike member is deflated and a wrist pouch inflated, a flap is tightened to pull the fingertips down and to curl the fingers inwardly towards the palm of the user.

This apparatus, however, requires the use of at least two inflatable members for moving the hand in either direction. Although it is simpler than the other complex systems which have been developed for similar purposes, it does require distinct inflatable pouches whose movements can be coordinated with one another.

CLARK et al., U.S. Pat. No. 3,457,912 is a complex system involving a pneumatically actuated apparatus for extending and closing the fingers of a patient. The apparatus utilizes inflation to extend the fingers but depends upon driven cords to pull individual fingers of a glove to close the fingers. SHERBOURNE, U.S. Pat. No. 3,581,740, discloses an apparatus whose use is limited to straightening the fingers of a patient. No motion can be imparted to the fingers to close them or to repeat the exercise cycle. KETCHUM, U.S. Pat. No. 3,756,222, discloses a hand splint for exercising fingers which includes a plurality of flexible elements for manipulating the fingers of a patient. DANIELS et al., U.S. Pat. No. 3,020,908, discloses a splint which can be attached to the hand of a patient to manipulate and exercise the same. None of these devices, however, manipulate selected body portions in as efficient, simple, and inexpensive a fashion as the present invention. None disclose the use of springs to bias a joint into a flexed position and a pneumatic pouch to extend the joint.

SUMMARY OF THE INVENTION

It is a general object of the present invention to provide a new and improved exerciser for automatically exercising the fingers, hands, arms or legs of a patient.

It is a further object of the present invention to provide a simple device for exercising a predetermined body part of a user which depends on pneumatic pressure only for movement of the body part in one direction, and which automatically returns the body part to a non-extended position when the pneumatic means are not in operation.

Still another object of the present invention is to provide an exerciser device for preselected body portions which can periodically/intermittently extend and retract such body portions.

The joint flexor device in accordance with the present invention provides for cyclic flexure of fingers, elbows and knee joints. Although it is specifically disclosed as being directed to exercising such joints, it is not necessarily limited to these joints, and the principles described throughout this application could be applicable to other movable body joints. For the fingers the first embodiment involves the utilization of a flexible, inflatable pouch having a substantially cylindrical shape when inflated which is capable of flexing only one joint at a time. The diameter of the pouch is approximately twice that of a normal finger. The pouch extends from slightly beyond the tip of the finger to slightly past the wrist. Attached to the wrist end of the pouch is a hose or tube and a valve through which air can pass to inflate or deflate the pouch. A piece of spring steel, rounded in the middle and curved only slightly on the ends, is mounted on the surface of the pouch. The length of the spring, when straight, is approximately three quarters that of the pouch. The spring steel is mounted on the pouch by means of a pocket into which it is inserted. The pocket has a "VELCRO" flap at one end which closes over the end of the pocket.

The construction provides a significant advantage as the spring steel is thus easily removable. When the spring steel gets fatigued and can no longer provide as much force as is necessary to fully exercise the injured body part, it can be easily replaced. The spring steel can be removed for cleaning, if necessary. An additional advantage is that the spring can be removed and replaced by a stronger, or weaker, spring, depending on the force needed to bend the user's finger. The force required may change, for example depending on whether the user is an adult or child.

A small strap attaches the injured finger to one end of the pouch while a wrist strap attaches the wrist to the other end of the pouch. When the pouch is inflated, it straightens until the shape of the pouch matches the shape of the injured finger. The pouch is then attached to the finger and hand, using the finger and wrist straps. By pumping air in and out of the pouch in a controlled manner, the pouch and finger are flexed.

The second embodiment, or multiple joint finger flexor, involves the utilization of a wider pouch, which might be constructed, for example, from two or more single joint finger flexors connected to one another, side-by-side. The second embodiment operates in a manner identical to the first embodiment, differing only in that it can flex the joints of all of the fingers simultaneously. The flexor of the second embodiment is attached to the hand in a manner similar to that used in the first embodiment in that straps are used to attach the pouch to the wrist and to the fingers.

The preferred embodiments for the elbow and knee flexors represent a further modification of the first embodiment of the finger flexor. The elbow and knee flexors include relatively large pouches to accommodate the increased size of the arm and leg as compared with the finger. As with the finger, these units are inflated until they match the bend in the elbow or knee. They are then attached by straps to the upper and lower portions of the arm or leg, respectively, of a patient. The spring steel attached to the pouches of the elbow and knee flexors in a manner similar or identical to that in which they are attached to the finger flexor. Of necessity, in view of the relatively large size of the pouch which must be used, more springs are used and they are essentially longer, wider and thicker than those used in conjunction with the finger flexor.

In a first aspect of the present invention, an exerciser for manipulating a selected body part of a user is provided. The exerciser comprises a flexible, inflatable pouch having a tubular shape and an exterior surface. The exerciser also comprises means for attaching the inflatable pouch to the body part and means for resiliently biasing the selected body part into a first, non-extended position when the pouch is non-inflated. The exerciser also includes pneumatic means for inflating the pouch and for thereby overcoming the biasing means in order to move the body part into a second, extended position when the pouch is inflated, as well as means for mounting the biasing means on the exterior surface of the pouch.

The ends of the pouch are sealed, and the inflatable pouch comprises two layers of material bonded to each other. The biasing means comprises at least one spring which occupies a natural, bent position when said inflatable pouch is not inflated. The mounting means comprises means for detachably mounting the biasing means to the exterior surface of the pouch. The means for detachably mounting comprises a pocket attached to the pouch, the biasing means being inserted into the pocket. The pneumatic means comprises a pneumatic fluid supply tube attached to the pouch via a valve.

The pocket includes means for attaching a strip of material to a top portion of the exterior surface. The attaching means comprises two rows of stitches positioned substantially parallel and spaced apart from one another, running lengthwise along opposing edges of the strip, and wherein a first end of the strip is unattached to the exterior surface to form an open pocket end, and a second end of the strip is stitched to the exterior surface to form a closed pocket end. The pocket further comprises a flap attached to said exterior surface, the flap being adapted to be folded over and attached to the strip to close the pocket.

Finger strap attachment means is attached to a first end of the pouch for connecting the pouch to a selected body part, and wrist strap attachment means is attached to a second end of the pouch for connecting the pouch to the wrist of a user.

In a second embodiment of the invention a plurality of springs are positioned in a substantially parallel spaced-apart relation to one another along the exterior surface of the pouch and a plurality of pocket means are attached to the exterior surface of the pouch for mounting the plurality of springs. Each spring is adapted to extend across at least two fingers and comprises two bent portions adapted to bend two joints on each finger. The pouch is attached to the fingers and wrist of the user substantially as described above.

In a third embodiment of the invention one strap connects one end of the pouch to the wrist of a user and another strap connects the pouch to the upper arm of the user. In a fourth embodiment of the invention, one strap is attached to the ankle of a user and another strap is attached to the upper leg of the user.

According to the invention, there is provided an exerciser for manipulating a selected body part which comprises a flexible, inflatable pouch having a tubular shape and an exterior surface. The exerciser further comprises means for attaching the inflatable pouch to the body part and means for resiliently biasing the selected body part into a first, non-extended position when the pouch is non-inflated. The exerciser further comprises pneumatic means for inflating the pouch and for overcoming the bias of the resilient means to move the body part into a second, extended position when the pouch is inflated and means for mounting the biasing means on the exterior surface of the pouch. The biasing means comprises at least one spring which occupies a natural, bent position when the inflatable pouch is not inflated. The mounting means comprises means for detachably mounting the biasing means to the exterior surface of the pouch. The means for detachably mounting comprises a pocket attached to the exterior surface of the pouch, the biasing means being inserted into the pocket. The pneumatic means comprises a pneumatic fluid supply tub attached to the pouch via a valve.

The above and other objects, advantages and features of the present invention will become more fully apparent to those of ordinary skill in the art to which this invention pertains upon further review of this application.

BRIEF DESCRIPTION OF THE DRAWINGS

All of the details, features and advantages of the present invention will become more fully apparent to those of ordinary skill in the art to which the invention pertains from a review of the following brief description of the drawings, together with a review of the detailed description of the drawings which follows, the claims, and the appendant drawings. In the drawings, like reference numerals refer to like parts throughout, wherein:

FIG. 1 is a perspective view of a first embodiment of the present invention illustrating a finger exerciser or flexor having a pouch in its fully deflated positon;

FIG. 2 is a perspective view of the exerciser of FIG. 1 in its fully inflated position;

FIG. 3 is a side view of the exerciser of FIG. 1 in its partially inflated position, including the hand of a patient which is in its partially extended position.

FIG. 4 is a perspective view of a finger strap for the exerciser of FIG. 1;

FIG. 5 is a perspective view of a spring steel element used in the exerciser of FIG. 1, when in its natural bent position;

DETAILED DESCRIPTION OF THE DRAWINGS

Figure 6A:
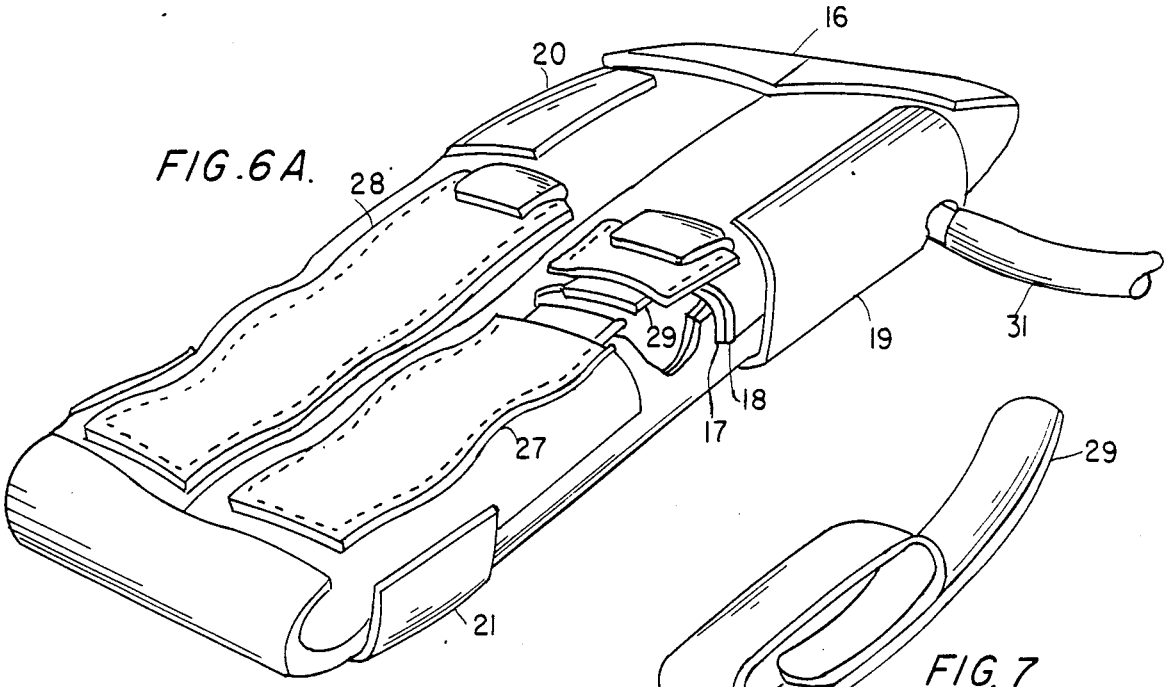
FIG. 6A is a perspective view of a second embodiment of the present invention illustrating a finger exerciser for exercising multiple joints of the fingers.

A first embodiment of the present invention is fully illustrated in FIGS. 1–5. The device is a finger exerciser or flexor which comprises a flexible, inflatable pouch. The pouch is shown in its fully deflated position in FIG. 1 and in its fully inflated position in FIG. 2.

The pouch is fabricated from two layers of flexible material, e.g., textile layers 2 and 3, as shown in the cutout portion of FIG. 2. Plies 2 and 3 are laminated together; the double layer of bonded material is overlapped and bonded to itself so as to form a substantially cylindrical tubular member. The diameter of the tube which forms pouch 1 is approximately twice that of a finger. The pouch extends from slightly beyond the tip of the finger to slightly past the wrist. The inside edges of both ends of the tube are coated with an adhesive and then flattened to seal the tube. The flattened ends are coated with adhesive and folded again as shown in FIGS. 1–3. The pouch shown in various embodiments of the flexor of the present invention will typically be constructed in the manner outlined above.

The sealed pouch is not in fluidic communication with the exterior of the pouch except through pressurized fluid supply tube 6, which is attached to one end of pouch 1. The pouch is normally in an uninflated condition, but can be inflated by directing air through fluid supply tube 6 and valve 7 via a suitable inflating device (not shown) which is capable of inflating and deflating pouch 1 in cyclical fashion.

The bend in pouch 1, as shown in FIG. 1, is caused by a spring steel element 5, shaped generally as shown in FIG. 5. Spring steel element 5 is rounded in the middle and curved only slightly on the ends. The length of spring 5, when straight, is approximately three quarters the length of pouch 1. Although only one spring is shown in the first embodiment, two or more could be used. Some of these additional springs could also be mounted to the bottom surface of pouch 1, as shown in FIG. 3.

In the preferred embodiment, spring steel 5 is mounted to pouch 1 using a pocket made of a strip of "VELCRO". A narrow strip 8 of soft "VELCRO" is attached to top layer 2. Strip 8 is sewn to the top surface of pouch 1, using two rows of stitches, positioned on either side of strip 8. The rows are spaced far enough apart to permit spring steel 5 and any additional springs to be inserted into the opening between material layer 2 and strip 8. One end of strip 8 is stitched closed and the other end remains open. Flap 9 is attached at the open end. Flap 9 is made of hard "VELCRO" material and is positioned between strip 8 and pouch 1. Spring steel 5 is held in place by flap 9. Flag 9 folds over and attaches to soft "VELCRO" strip 8, thereby closing the pocket.

If a spring is also to be attached to the bottom surface of pouch 1, as shown in FIG. 3, it can be secured to pouch 1 in a like manner as described above.

The construction described for attaching spring steel 5 to pouch 1 in the preferred embodiment allows the spring to be removed very easily. Thus, it can be easily replaced when it is fatigued and can no longer provide as much force as is necessary to fully exercise the injured body part.

As shown in FIG. 1, there are two flaps 10 and 11, of hard "VELCRO" which extend beyond the sides of pouch 1 at the bottom surface of the pouch positioned on the same end of the pouch as tube 6. These flaps can be formed by attaching one continuous piece of hard "VELCRO" to the bottom surface. Alternatively, they may be formed by attaching two pieces of hard "VELCRO" to the bottom surface. Flaps 10 and 11 are used to secure wrist strap 12 to pouch 1. Wrist strap 12 is made of a rectangular piece of soft "VELCRO".

There are two strips, 13 and 14, of hard "VELCRO" attached to each side of pouch 1. Strips 13 and 14 are positioned on the opposite end of pouch 1 from that on which flaps 10 and 11 are found, best illustrated in FIGS. 1–3. The strips 13 and 14 are used to secure finger strap 15 (FIG. 4) to pouch 1, as shown in FIG. 3. Finger strap 15 comprises a rectangular piece of soft "VELCRO" which is formed into a V-shaped strap. Although one finger strap is shown, any number of straps may be used in accordance with the need to securely strap the hand of the patient to the upper portion of pouch 1.

FIG. 3 illustrates the use of the finger flexor of the present invention. Pouch 1 can be used on any injured joint of any finger. For illustration purposes, the first joint of the index finger has been arbitrarily chosen. It is assumed that this joint remains somewhat bent as shown, and can be moved only with considerable pain. To accommodate flexure, pouch 1 is inflated until the shape of the extended pouch matches the bend in the injured joint. At this point, pouch 1 is placed under the hand and injured finger, so that the bend in pouch 1 lines up with the bend in the injured finger. Finger strap 15 is placed over the end of the finger and secured to pouch 1 by hard "VELCRO" strips 13 and 14. With the wrist and hand now resting on pouch 1, as shown in FIG. 3, wrist strap 12 is attached to either of the hard "VELCRO" flaps 10 and 11 (see FIG. 2). Wrist strap 12 is then brought across the wrist and attached to the remaining one of flaps 10 or 11. The wrist is thus secured to pouch 1.

With the wrist and finger properly secured to pouch 1, a small amount of additional air is now added to inflate pouch 1. The air is pumped into pouch 1 by using a suitable inflating device or pumping unit. Pouch 1 inflates, forcing the finger to extend slightly. Next, a small amount of air is removed from pouch 1 by the same pumping unit. Pouch 1 deflates slightly, which causes the finger to bend. This process is repeated in a cyclic manner until the degree of pain subsides. At this point, the process of increasing the degree of flexure, as described above, is repeated as often as necessary.

FIG. 5 illustrates spring steel element 5 used in the first embodiment of FIG. 1. Spring steel element 5 is made of a piece of spring steel, rounded in the middle and curved only slightly on the ends. The length of spring 5, when straight, is approximately three quarters the length of the pouch.

A second embodiment of the finger flexor of the present invention is fully illustrated in FIGS. 6–10. As shown in FIG. 6A, two layers of material 17 and 18 are laminated together. Then the bonded material is folded over and the edge sealed, to form a single loop. The ends of the single loop are sealed and folded over, as described with respect to FIG. 1. A row of stitches is sewn parallel to the bonded edge and located in the center of the large loop so as to form two small loops from the single large loop. Alternatively, as shown in the cross-sectional view of FIG. 6B, pouch 16 can be fabricated from a rectangular piece of material 17. The two edges on one side of material 17 are overlapped slightly and then bonded together.

The ends of the single loop thus formed are sealed and folded over, as described with respect to FIG. 1. The single loop thus formed is laid flat and a row of stitches is sewn parallel to the bonded edge and located in the center of the large loop so as to form two small loops from the single large loop. The stitches are sealed with adhesive. Another layer 18 of material is then bonded to the first layer, as described for the first embodiment.

Two pieces of hard "VELCRO" patches 19 and 20 are attached to sides of pouch 16 at the end on which inflating tube 31 is attached. Patches 19 and 20 are used to secure soft "VELCRO" wrist strap 30 to pouch 16.

Hard "VELCRO" patch 21 is attached to the bottom surface of the pouch 16 at the opposite end from patches 19 and 20. Patch 21 is used to secure finger strap 22 to pouch 16. Finger strap 22 consists of a rectangular piece of plexiglass or other appropriate material. This plexiglass is covered with material piece 24, similar to the material used for layers 17 and 18. Attached to the end of members 23 and 24 are two straps 25 and 26, fabricated from soft "VELCRO".

Figure 7:
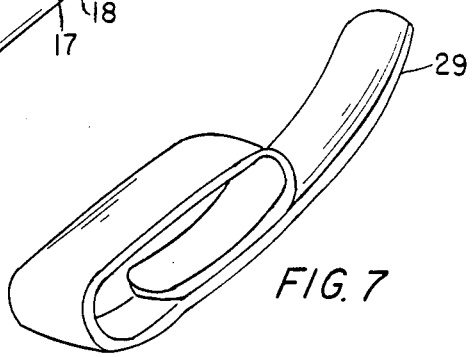
FIG. 7 is a perspective view of a spring steel element used in the exerciser of FIG. 6, when in its natural bent position.

Pockets or housings 27 and 28 are attached to the top surface of pouch 16 to removably mount the spring steel 29 used in this embodiment. A typical spring 29 is shown in FIG. 7, in its natural bent position, as it would appear if removed from its housing. Spring 29 is shown as having two circular sections, in contrast to the one pictured in FIG. 5. The two bends in spring 29 allow the flexor to bend two joints on each finger, rather than only one.

Figure 10:
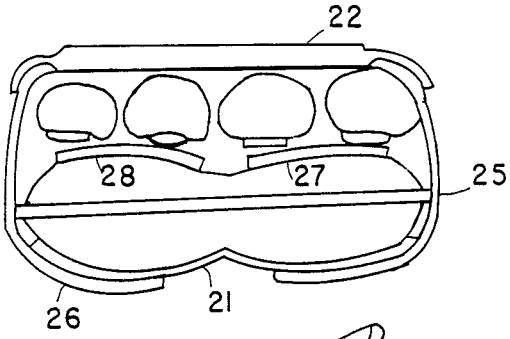
FIG. 10 is an end view of the fingers of a user, illustrating the use of the finger strap of FIG. 8 in the exerciser of FIG. 6.
Figure 8:
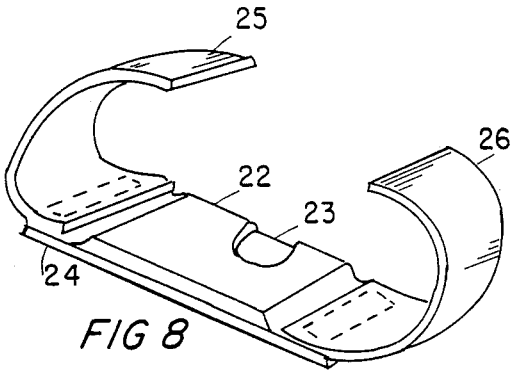
FIG. 8 is a perspective view of a finger strap for the exerciser of FIG. 6.
Figure 9:
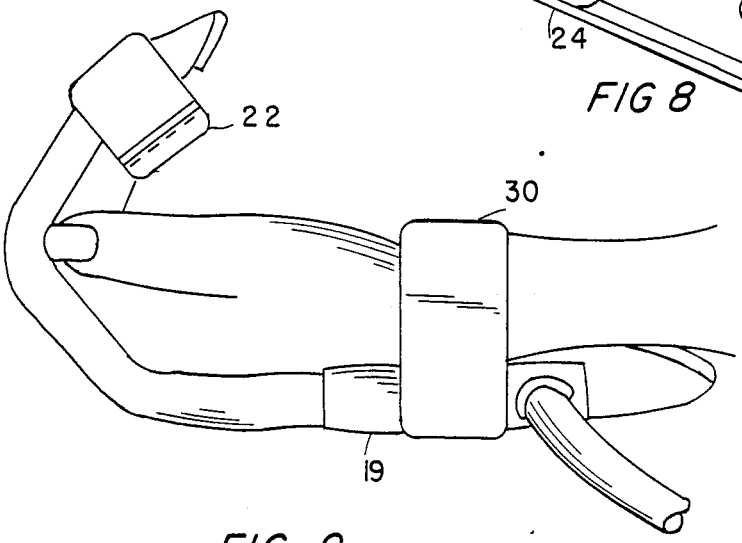
FIG. 9 is a side view of the exerciser of FIG. 6 in its partially inflated position, including the hand of a patient which is in its partially extended position.
Figure 12:
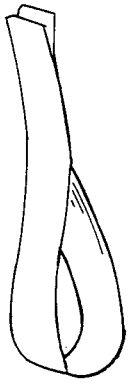
FIG. 12 is a perspective view of the spring steel element used in the full arm exerciser of FIG. 11.

The second embodiment allows not only more than one joint to be exercised (FIGS. 7 and 9), it also allows more than one finger to be exercised at once, as most clearly shown in FIG. 10. When pouch 16 is inflated to match the shape of the fingers, the fingers are secured to pouch 16 using finger strap 22, as illustrated in FIG. 10. As can be seen, finger strap 22 is placed over the fingers, and soft "VELCRO" straps 25 and 26 are secured to hard "VELCRO" patch 21. Soft "VELCRO" wrist strap 30 is placed over the wrist and secured to hard "VELCRO" patches 19 and 20 (FIGS. 6 and 9).

The preferred embodiment for the elbow flexor is fully illustrated in FIGS. 11–15. As can be seen, the elbow flexor is similar in appearance and construction to the second embodiment of the finger flexor. The only significant difference involves the utilization of pouch 39 which is longer and wider than pouch 16. This accommodates the greater length and width of the arm (as compared to the fingers) of a user. The elbow flexor contains springs (four are shown for illustration purposes) similar to that shown in FIG. 12. The springs are removably mounted to pouch 39 using pockets 38 in a manner identical to that used for the finger flexors.

Figure 11:
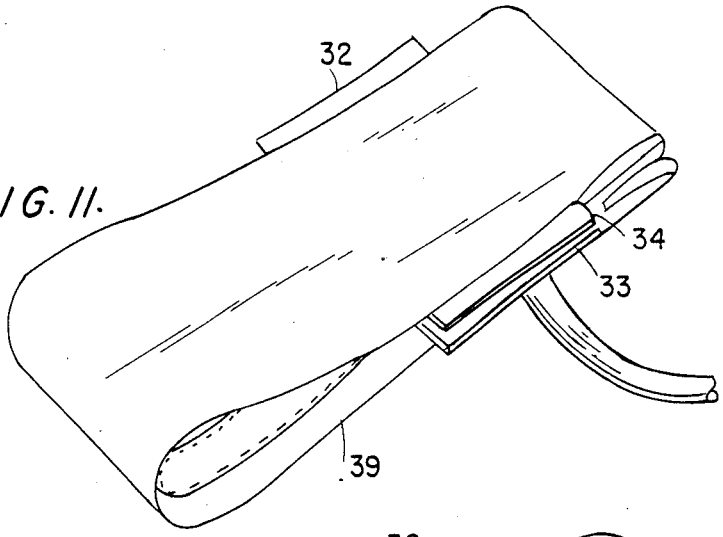
FIG. 11 is a perspective view of a third embodiment of the present invention illustrating a full arm exerciser having a pouch in its fully deflated position.
Figure 13:
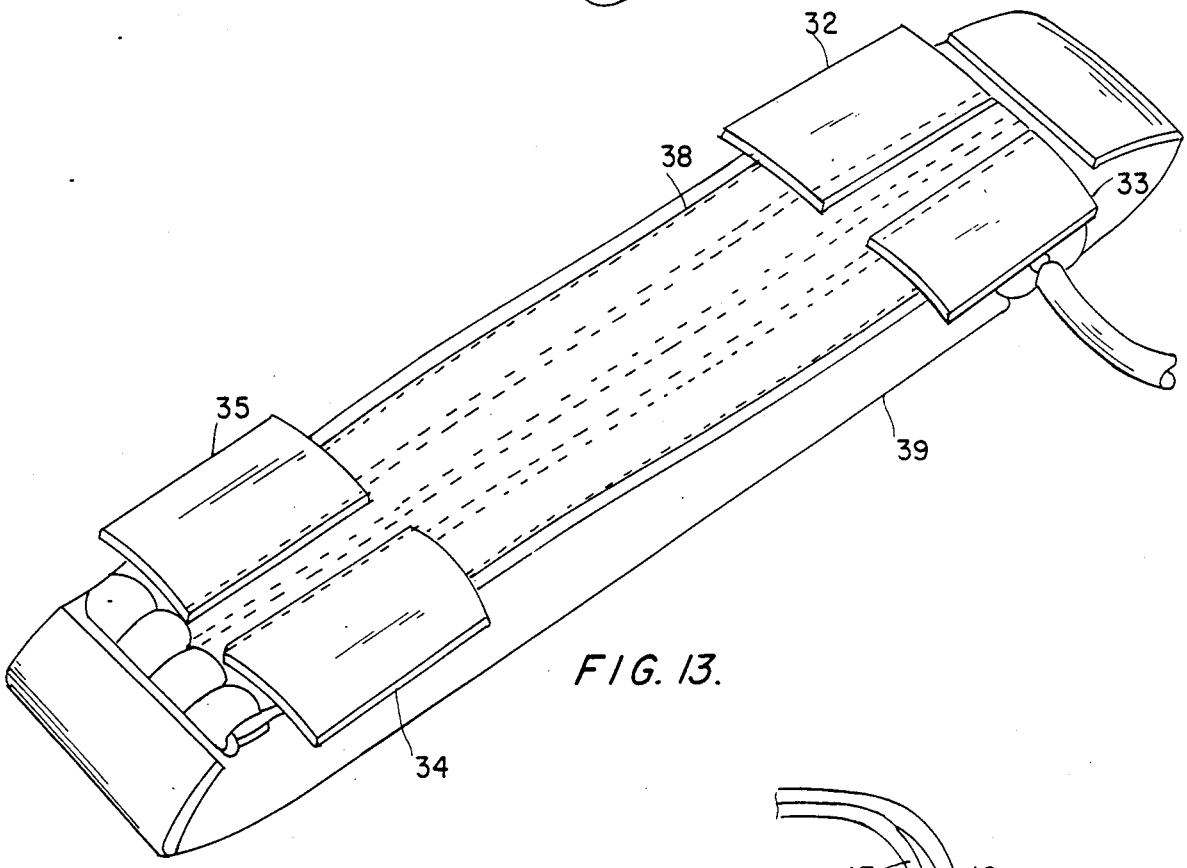
FIG. 13 is a perspective view of the full arm exerciser of FIG. 11 with the pouch in its fully inflated position.
Figure 6B:
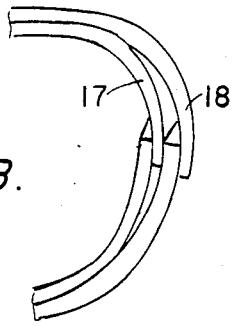
FIG. 6B is a cross-sectional view illustrating an alternative construction of the pouch FIG. 6A.

FIG. 11 illustrates pouch 39 of the elbow flexor in its fully deflated position. FIG. 13 illustrates pouch 39 in its fully inflated position.

Figure 14:
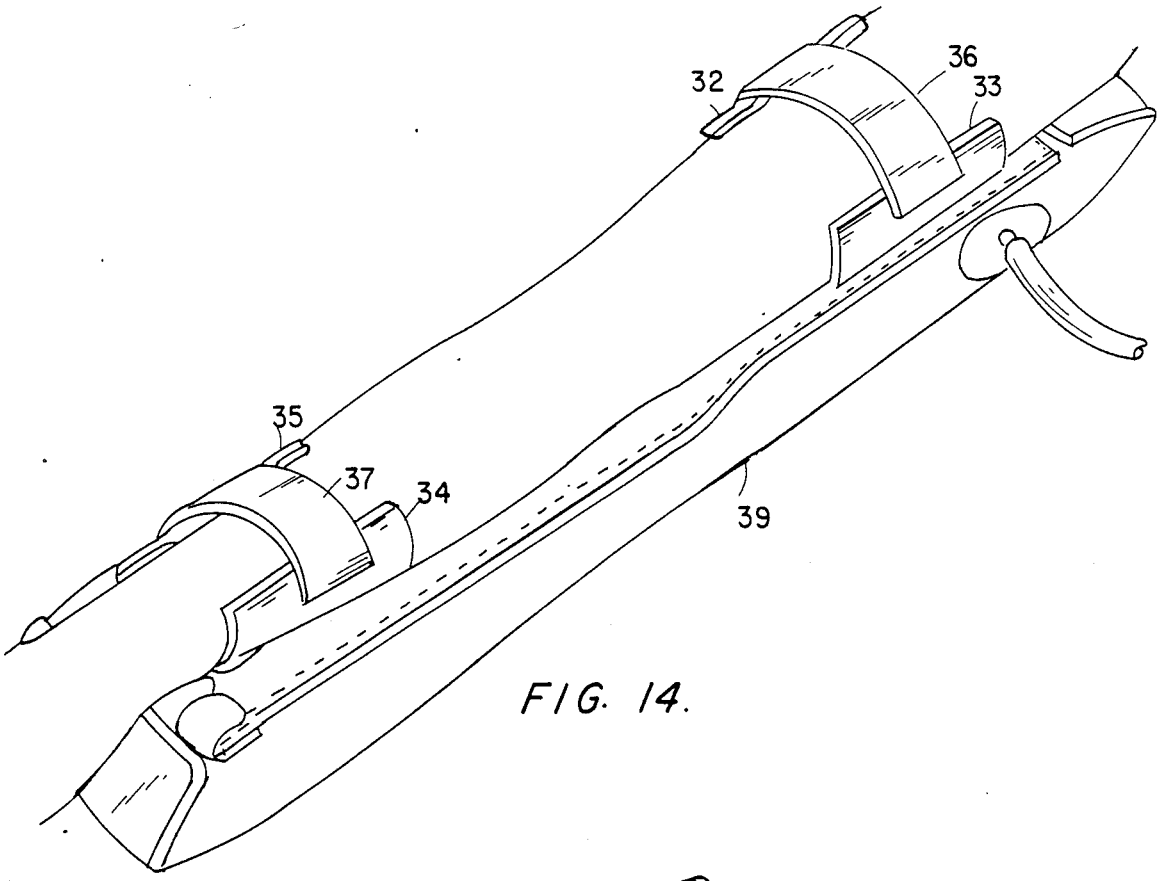
FIG. 14 is a perspective view of the full arm exerciser of FIG. 11 with the pouch in its fully inflated position and including the arm of the patient.

To use the elbow flexor, pouch 39 is inflated, partially or fully, to match the bend in the arm of the user. Pouch 39 is then placed under the arm, as shown in FIG. 14, so that the elbow rests in the middle of pouch 39. This location is well defined by the characteristic dip caused by the springs (see FIG. 13). This dip will occur even when the pouch is fully inflated.

Next, a soft piece of "VELCRO" strap 36 is attached to one of the two hard "VELCRO" flaps 32 and 33, each of which is attached to one end of pouch 39, as shown in FIG. 14. Strap 36 is then brought across the upper arm and attached to the remaining flap 32 or 33. In a like manner, the wrist is secured to pouch 39 using soft "VELCRO" strap 37 and hard "VELCRO" flaps 34 and 35.

Figure 15:
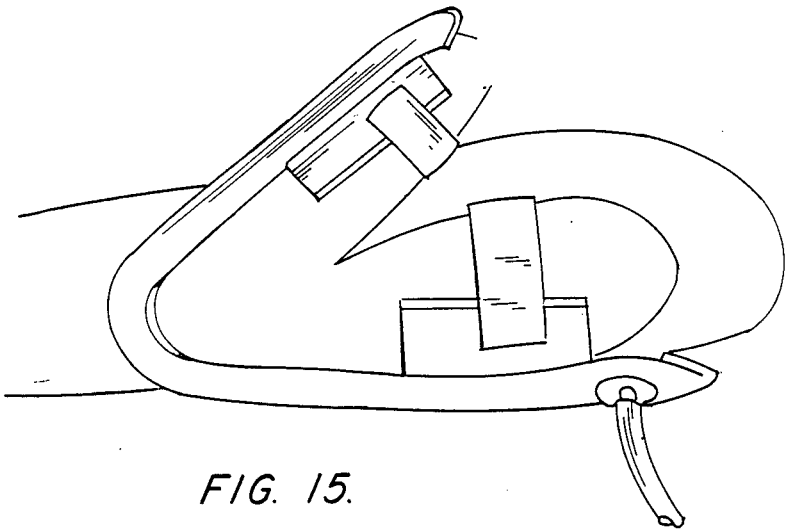
FIG. 15 is a perspective view of the full arm exerciser of FIG. 11 with the pouch in its fully deflated position and including the arm of the patient.

With the arm properly secured to pouch 39, a pumping unit, similar to that used with the finger flexor, is used to pump air into and out of pouch 39. Thus the pouch 39 is alternatively straightened and bent, causing the flexing and exercise of the elbow. FIG. 14 illustrates the elbow flexor fully inflated, including the straight arm of the patient, while FIG. 15 illustrates the elbow flexor fully deflated, including the flexed arm of the patient.

Figure 16:
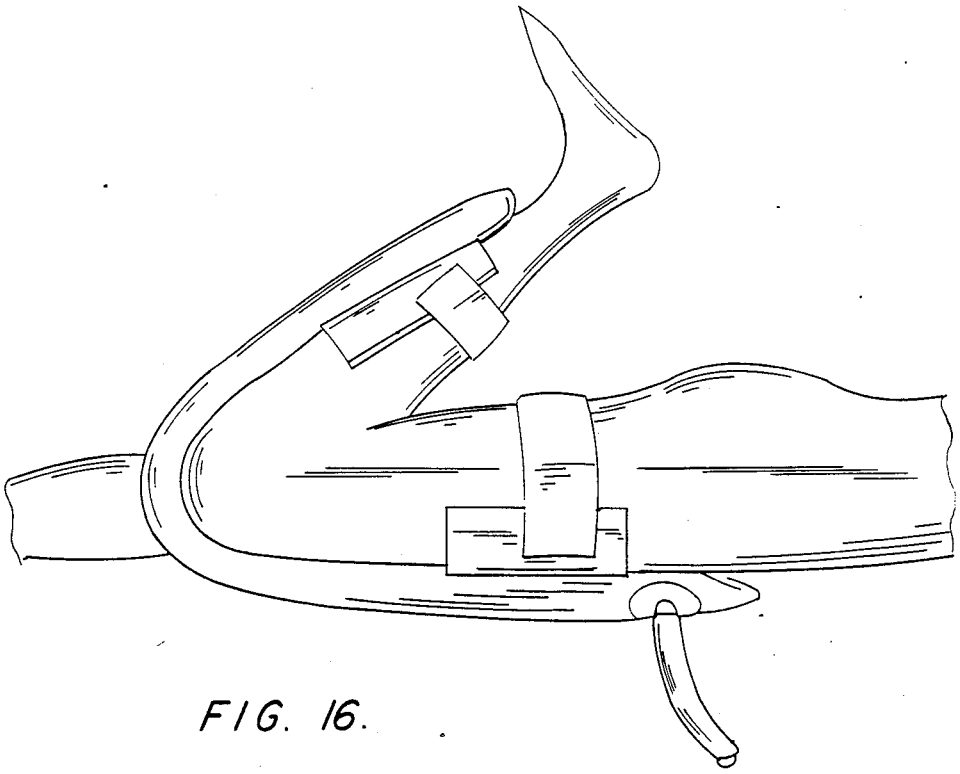
FIG. 16 is a perspective view of a fourth embodiment of the present invention, illustrating a knee exerciser having a pouch in its fully deflated position, and including the knee of a patient.

The preferred embodiment for the knee flexor is illustrated by FIG. 16. The construction is very similar to that of the elbow flexor. The knee flexor is wider and longer than the elbow flexor. It may also contain additional springs.

It is possible that both the elbow and knee flexor may require additional straps similar to straps 36 and 37 of FIG. 14, in order to maintain the arm or leg in a proper position relative to the pouch as the joints are being flexed. It is also possible that an identical flexor could be used for both the elbow and the knee exerciser. As illustrated in FIG. 15, the patient is placed on his back when flexing his elbow joint and on his stomach (see FIG. 16) when flexing a knee joint.

It is to be understood that the forms of the invention as disclosed are merely preferred embodiments. Various changes and modifications can be made in shape, size or arrangement of the parts and equivalent means can be substituted for those illustrated and described without departing from the spirit and scope of the present invention.

What is claimed is:

1. A exerciser for manipulating a selected body part, said exerciser comprising:

(a) a flexible, inflatable pouch having a tubular shape and an exterior surface, said pouch having two ends which are sealed and an upper surface;

(b) means for attaching said inflatable pouch to said body part;

(c) means for resiliently biasing said selected body part into a first, non-extended position when said pouch is non-inflated, said biasing means comprising at least one spring which is positioned adjacent to an upper surface of said inflatable pouch and which has a natural generally curved central configuration when said inflatable pouch is not inflated;

(d) pneumatic means for inflating said pouch and for overcoming the bias of said resilient means to move said body part into a second, extended position when said pouch is inflated; and (e) means for mounting said biasing means on the exterior surface of said pouch.

2. An exerciser in accordance with claim 1, wherein said inflatable pouch comprises two layers of material bonded to each other.

3. An exerciser in accordance with claim 1, wherein said mounting means comprises means for detachably mounting said biasing means to said exterior surface of said pouch.

4. An exerciser in accordance with claim 3 wherein said means for detachably mounting comprises a pocket attached to said pouch, said biasing means being inserted into said pocket.

5. An exerciser in accordance with claim 4 wherein said pneumatic means comprises a pneumatic fluid supply tube attached to said pouch via a valve.

6. An exerciser in accordance with claim 4 wherein said pocket includes means for attaching a strip of material to a top portion of said exterior surface.

7. An exerciser in accordance with claim 6, wherein attaching means comprises two rows of stitches positioned substantially parallel and spaced apart from one another, running lengthwise along opposing edges of said strip, and wherein a first end of said strip is unattached to said exterior surface to form an open pocket end, and a second end of said strip is stitched to said exterior surface to form a closed pocket end.

8. An exerciser in accordance with claim 7, wherein said pocket further comprises a flap attached to said exterior surface, said flap being adapted to be folded over and attached to said strip to close said pocket.

9. An exerciser in accordance with claim 8, further comprising finger strap attachment means attached to a first end of said pouch for connecting said pouch to said selected body part.

10. An exerciser in accordance with claim 9, further comprising wrist strap attachment means attached to a second end of said pouch for connecting said pouch to the wrist of a user.

11. An exerciser in accordance with claim 10, wherein said wrist strap attachment means comprises a piece of "Velcro" self fastening material attached to said second end of said pouch on the bottom of said exterior surface of said pouch, and a rectangular piece of "Velcro" self fastening material, said rectangular material adapted to be placed over the wrist of the user and attached to said piece of "Velcro" self fastening material mounted to sides of said pouch.

12. An exerciser in accordance with claim 11, wherein said finger strap attachment means comprises at least one piece of "Velcro" self fastening material attached to said first end of said pouch and a rectangular piece of "Velcro" self fastening material, said rectangular material adapted to be placed over the ends of the fingers of the user and attached to said piece of "Velcro" self fastening material mounted to a side of said pouch.

13. An exerciser in accordance with claim 10, comprising:

(a) a plurality of said springs positioned in a substantially parallel, spaced-apart relation to one another along the exterior surface of said pouch; and (b) a plurality of pockets attached to the exterior surface of said pouch for mounting said plurality of springs.

14. An exerciser in accordance with claim 13, wherein each spring possesses a curved section located adjacent the body joint to be exercised.

15. An exerciser in accordance with claim 14, wherein said finger strap attachment means comprises a piece of "Velcro" self fastening material, attached at a first end at a bottom portion of said pouch, and a strap, which comprises a rectangular piece of plexiglass covered with a material layer and two pieces of "Velcro" self fastening material attached to first and second ends of said material layer, adapted to be placed over the fingers of said patient and attached to said piece of "Velcro" self fastening material attached to said first end.

16. An exerciser in accordance with claim 8 which comprises:

(a) a plurality of said springs positioned in substantially parallel relation to one another along said exterior surface of said pouch; and (b) a plurality of pockets attached to said exterior surface of said pouch for detachably mounting said plurality of springs.

17. An exerciser in accordance with claim 16 which comprise a first strap for connecting one end of said pouch to one end of a body joint, and a second strap for connnecting a second end of said pouch to a second end of a body joint.

18. An exerciser in accordance with claim 17, wherein each of said first and second straps comprises two pieces of "Velcro" self fastening material attached to respective ends of said pouch and two pieces of "Velcro" self fastening material adapted to be placed over body parts located on either side of a joint to be exercised and attached to said two pieces of "Velcro" self fastening material attached to said pouch.

19. An exerciser in accordance with claim 16 further comprising a first strap for connecting one end of said pouch to the ankle of a user and a second strap for connecting another end of said pouch to an upper leg of a user.

20. An exerciser in accordance with claim 19, wherein said first and second straps each comprises two pieces of hard "VELCRO" attached to respective ends of said pouch and a rectangular piece of soft "VELCRO" adapted to be placed over the ankle and the upper leg of a user, respectively, and attached to said two pieces of hard "VELCRO".

21. An exerciser for manipulating a selected body part, said exerciser comprising:

(a) a flexible, inflatable pouch having a tubular shape and an exterior surface;

(b) means for attaching said inflatable pouch to said body part;

(c) means for resiliently biasing said selected body part into a first, non-extended position when said pouch is non-inflated;

(d) pneumatic means for inflating said pouch and for overcoming the bias of said resilient means to move said body part into a second, extended position when said pouch is inflated;

(e) means for mounting said biasing means on the exterior surface of said pouch;

(f) said biasing means comprising at least one spring which occupies a naturally curved generally central configuration when said inflatable pouch is not inflated, said spring thus comprising means for biasing both the body part and the pouch into said non-extended position;

(g) said mounting means comprising means for detachably mounting said biasing means to said exterior surface of said pouch, said means for detachably mounting comprising a pocket attached to said exterior surface of said pouch, said biasing means being inserted into said pocket; and (h) said pneumatic means comprising a pneumatic fluid supply tube attached to said pouch via a valve.

* * * * *

UNITED STATES PATENT AND TRADEMARK OFFICE

CERTIFICATE OF CORRECTION

PATENT NO. : 4,671,258

DATED : June 9, 1987

INVENTOR(S) : Donald E. BARTHLOME

It is certified that error appears in the above-identified patent and that said Letters Patent is hereby corrected as shown below:

At column 2, line 18 of the printed patent, insert ---,--- after "fingers" and before "the".

At column 3, line 50 of the printed patent, substitute ---A finger--- for "Finger".

At column 3, line 52 of the printed patent, insert ---a--- after "and" and before "wrist".

At column 6, line 50 of the printed patent, insert ---one --- after "either" and before "of".

At column 7, line 50 of the printed patent, insert ---but --- after "(Figs. 7 and 9)," and before "it".

At column 8, line 54 (claim 1, line 1) of the printed patent, change "A" before "exerciser" to ---An---.

At column 10, line 27 (claim 17, line 2) of the printed patent, change "comprise" to ---comprises---.

Signed and Sealed this

Fourth Day of October, 1988

*Attest:*

*Attesting Officer*

DONALD J. QUIGG

*Commissioner of Patents and Trademarks*